US005620213A

United States Patent [19]

Ellis

[11] Patent Number: 5,620,213

[45] Date of Patent: Apr. 15, 1997

[54] WINDOW LOCK

[76] Inventor: Frederick G. Ellis, 80 Burnett Avenue, Winnipeg, Manitoba, Canada, R2G 1C1

[21] Appl. No.: 576,987

[22] Filed: Dec. 26, 1995

Related U.S. Application Data

[63] Continuation-in-part of Ser. No. 193,528, Feb. 8, 1994, abandoned.

[51] Int. Cl.[6] ..... E05C 3/04

[52] U.S. Cl. ..... 292/210; 292/100; 292/DIG. 20

[58] Field of Search ..... 292/210, 200–202, 292/DIG. 30, DIG. 20, 241, 336, 341.13, 97, 100, DIG. 47

[56] References Cited

U.S. PATENT DOCUMENTS

| | | | |
|---|---|---|---|
| 459,063 | 9/1891 | Bushey | 292/102 |
| 510,776 | 12/1893 | Coey | 292/210 |
| 585,110 | 6/1897 | Lee | 292/210 |
| 917,379 | 4/1909 | Tayntor | 292/DIG. 20 |
| 2,538,385 | 1/1951 | Schurman . | |
| 2,755,519 | 7/1956 | Xander | 292/DIG. 20 |
| 3,240,523 | 3/1966 | Heimann . | |
| 4,268,077 | 5/1981 | Bohleen . | |
| 4,318,557 | 3/1982 | Bourue . | |
| 4,542,924 | 9/1985 | Browne . | |
| 4,610,472 | 9/1986 | Billingsley | 292/241 |
| 4,632,440 | 12/1986 | Adrian | 292/210 |
| 4,674,777 | 6/1987 | Guelck . | |
| 4,877,274 | 10/1989 | Poe . | |
| 4,991,885 | 2/1991 | Poe . | |
| 5,090,750 | 2/1992 | Lindqvist | 292/DIG. 20 |
| 5,398,447 | 3/1995 | Morse | 292/DIG. 20 |
| 5,421,627 | 6/1995 | Yane | 292/101 |
| 5,489,131 | 2/1996 | Blom | 292/DIG. 20 |

FOREIGN PATENT DOCUMENTS

| | | | |
|---|---|---|---|
| 474548 | 1/1936 | United Kingdom . | |
| 197804 | 10/1974 | United Kingdom . | |
| 1508800 | 11/1974 | United Kingdom | 292/DIG. 20 |

*Primary Examiner*—Steven N. Meyers
*Assistant Examiner*—Gary Estremsky
*Attorney, Agent, or Firm*—Adrian D. Battison; Murray E. Thrift

[57] ABSTRACT

A lock for a window includes a lock body mountable on the window frame having a base plate and a raised portion standing upwardly from the base plate. The raised portion is a hollow interior within which a lock handle projects and on which is mounted the lock handle for pivotal action about a pin transverse to the raised portion. The raised portion defines a substantially rectangular flat upper surface parallel to the base plate. The handle portion includes a flat plate acting as a cover for the rectangular upper surface together with a manually graspable arch shaped element projecting beyond the end of the plate portion. Within a recess underneath the arch shaped portion is provided a trigger latch engageable with a web across the hollow interior of the raised portion for latching the handle in a lowered lock position.

19 Claims, 7 Drawing Sheets

WINDOW LOCK

This application is a continuation-in-part application of application Ser. No. 08/193,528 filed 8 Feb. 1994 and now abandoned.

BACKGROUND OF THE INVENTION

This invention relates to a window lock of the type comprising a lock body for mounting on a window frame and a lock handle mounted on the lock body for pivotal movement relative thereto, the lock handle including an actuator element which extends through a hollow interior of the lock body for engaging an element of the window to hold the window in locked position against the window frame.

Many different designs and arrangements of lock handle of this type have been provided and it is previously known to provide engagement of the lock handle with the window in a number of different ways. In one technique, the lock handle includes simply a hook shaped element which engages over a suitable abutment on the window. In other arrangements it is known to provide on the lock handle an actuator which operates movement of a bar longitudinally of the window frame with the bar acting to engage an abutment on the window. The bar can simply engage a single element on the window frame or it can engage a number of longitudinally spaced abutments on the window frame to provide locking at different positions along the window.

The locking action is of course provided in order to hold the window tight against seals to prevent penetration of air and in addition the locking effect is provided for security purposes to prevent an intruder forcing the window open.

SUMMARY OF THE INVENTION

It is one object of the present invention to provide an improved arrangement of window lock of the above type.

According to the first aspect of the invention there is provided a window lock comprising a lock body for mounting on a window frame and a lock handle for pivotal movement relative to the lock body, the lock body including a base portion engageable onto a surface of the window frame, a raised portion for projecting outwardly from the surface and a hollow interior of the raised portion, the lock handle including a mounting portion engageable with the raised portion for pivotal movement relative thereto about an axis transverse to the raised portion and the handle from a first lock position to a raised release position, and a manually graspable portion extending from said mounting portion to a position at which at least one finger of a hand of a user can engage an under surface of the manually graspable portion for pulling the handle out of said lock position away from said surface of the window frame into said release position, actuator means mounted on the lock handle and extending through the hollow interior for engaging an element of a window to lock the window in a closed position and a latch member for releasably latching the lock handle in the lock position, the latch member being positioned such that it is manually movable by the hand of the user when engaging the manually graspable portion.

According to a second aspect of the invention there is provided a window lock comprising a lock body for mounting on a window frame and a lock handle for pivotal movement relative to the lock body, the lock body including a base portion engageable onto a surface of the window frame, a raised portion for projecting outwardly from the surface and a hollow interior of the raised portion, the lock handle including a mounting portion engageable with the raised portion for pivotal movement relative thereto about an axis transverse to the raised portion and the handle from a first lock position to a raised release position, and a manually graspable portion extending from said mounting portion to a position at which at least one finger of a hand of a user can engage an under surface of the manually graspable portion for pulling the handle out of said lock position away from said surface of the window frame into said release position, and actuator means mounted on the lock handle and extending through the hollow interior for engaging an element of a window to lock the window in a closed position, wherein the raised portion defines an upper face thereof lying substantially in a plane raised from the surface of the window frame and wherein the mounting portion of the lock handle comprises a substantially planar plate member, which in the lock position, substantially covers the upper face and is substantially coplanar therewith, the manually graspable portion of the lock handle being provided at one end of the plate member so as to project beyond an adjacent end of the raised portion and wherein there is provided pivot mounting means pivotally coupling the lock handle to the raised portion at an end thereof opposite to the manually graspable portion.

One embodiment of the invention will now be described in conjunction with the accompanying drawings in which:

BRIEF DESCRIPTION OF THE DRAWINGS

In the drawings like characters of reference indicate corresponding parts in the different figures.

DETAILED DESCRIPTION

Figure 1:
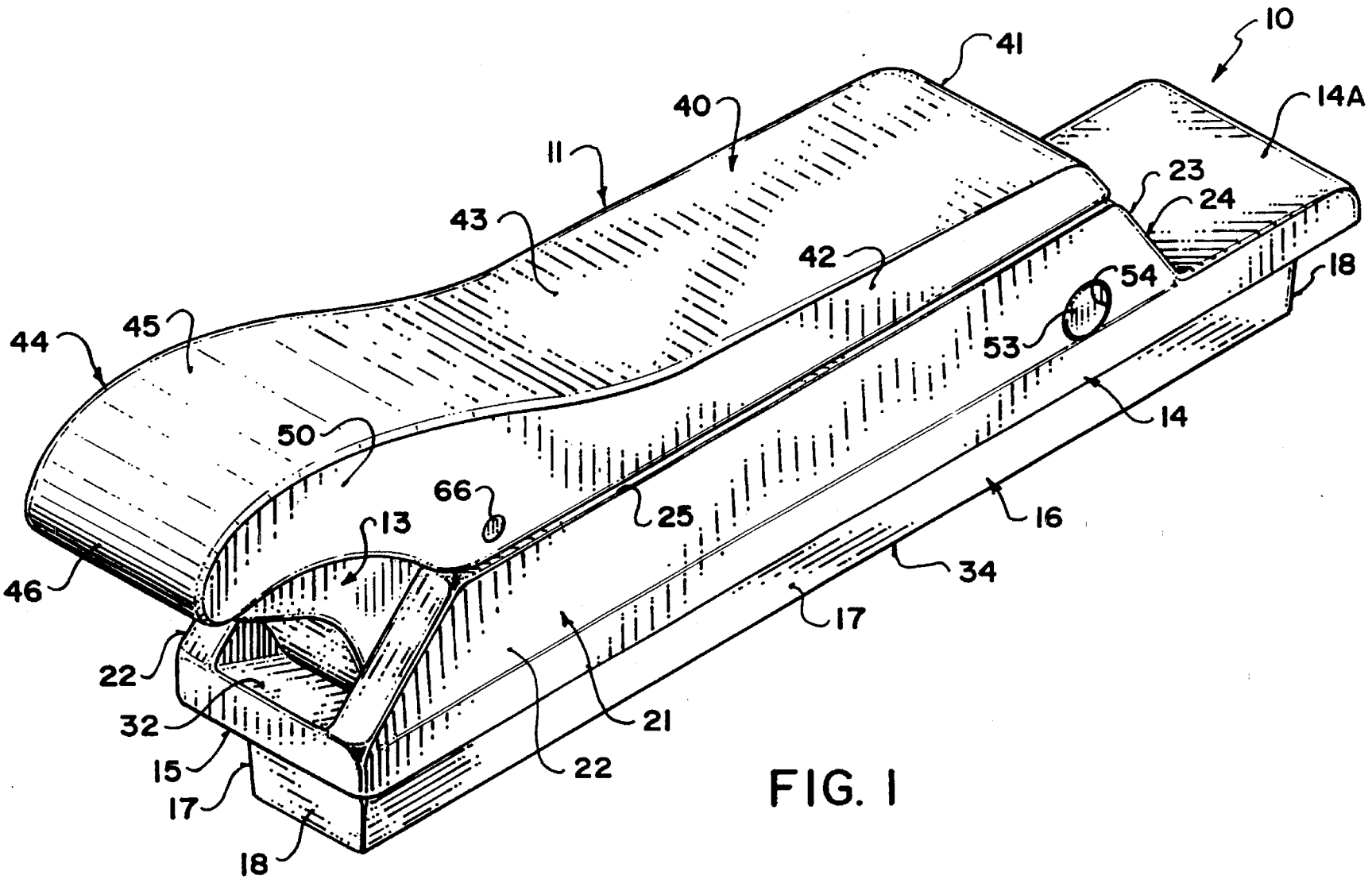
FIG. 1 is an isometric view of a window lock according to the present invention.
Figure 2:
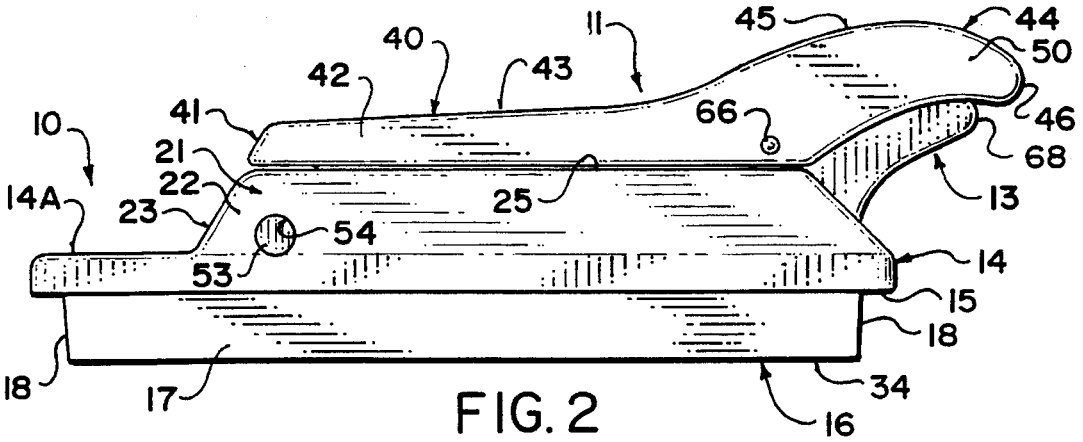
FIG. 2 is a side elevational view of the lock of FIG. 1.
Figure 3:
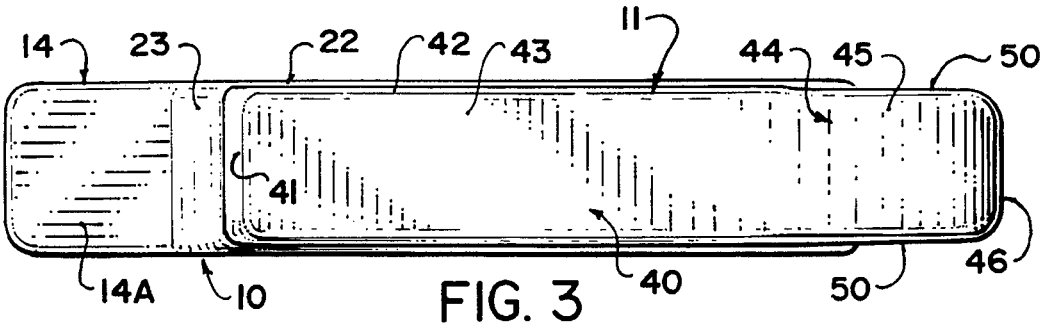
FIG. 3 is a top plan view of the lock of FIG. 1.
Figure 7:
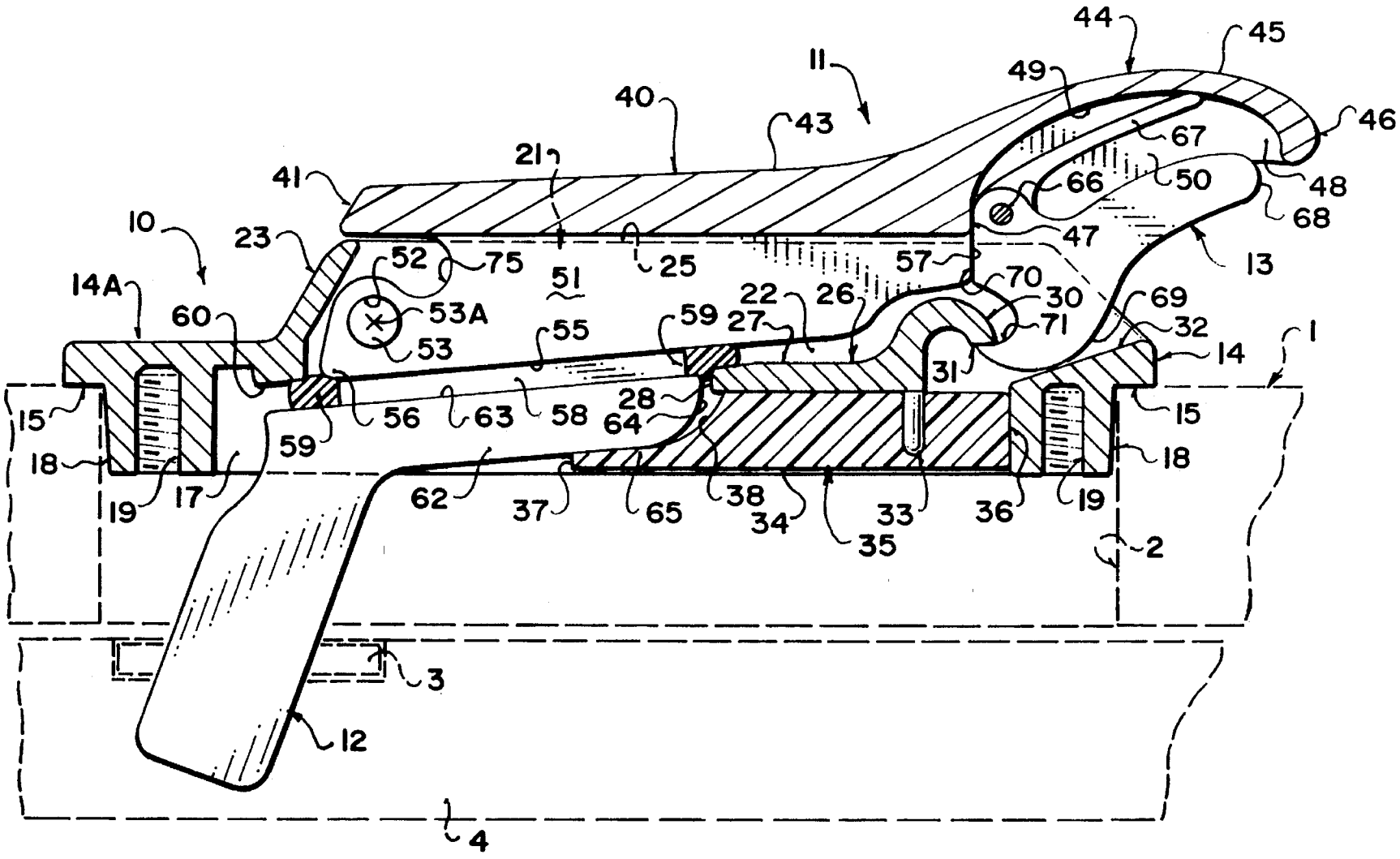
FIG. 7 is a longitudinal cross sectional view of the lock of FIG. 1 in the locked position shown in FIG. 1 and showing the lock mounted on a window frame engaging a window in a locking action.
Figure 8:
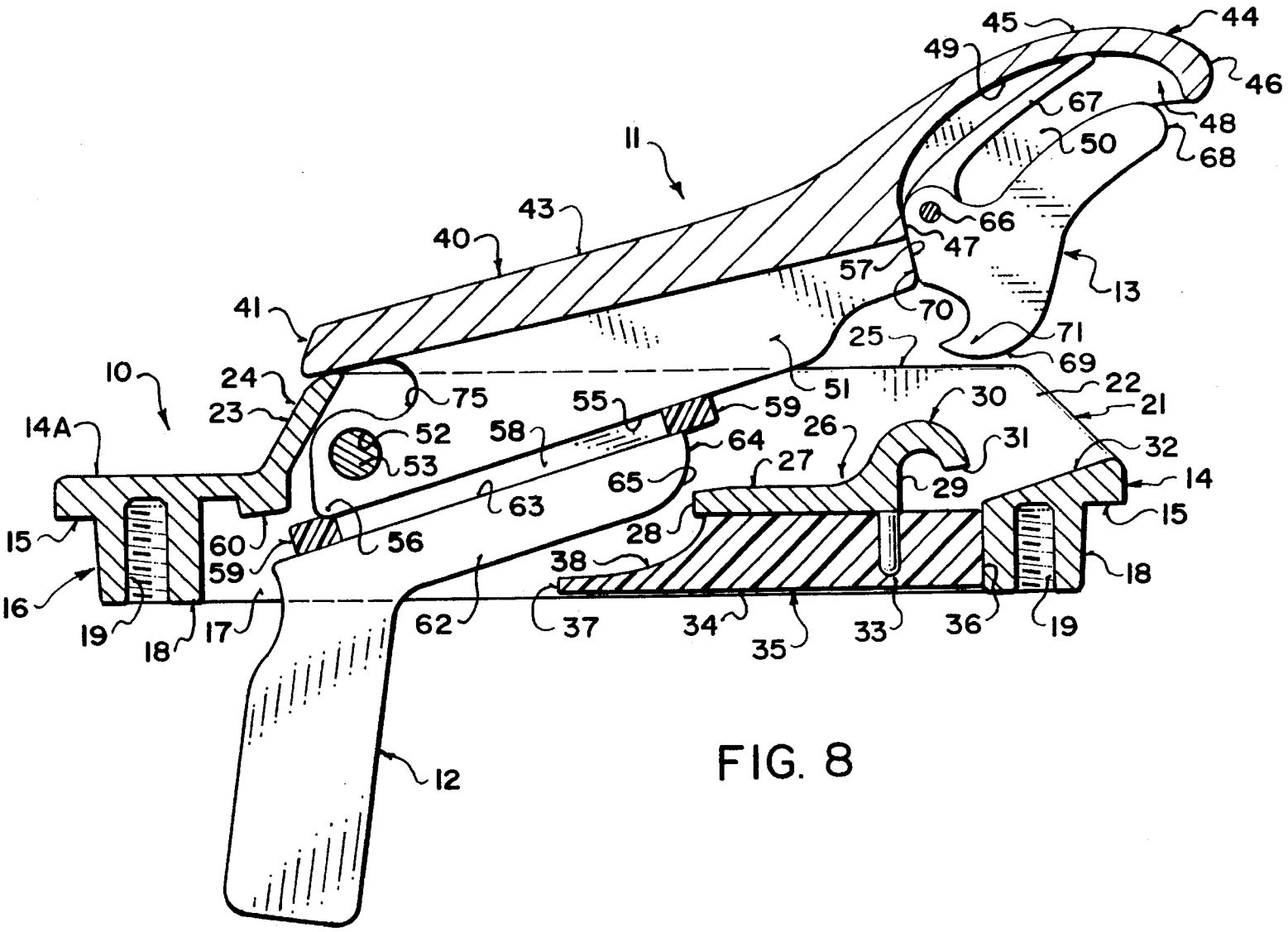
FIG. 8 is a similar longitudinal cross sectional view to that of FIG. 7 showing the lock handle in a partly raised release position.

The window lock as illustrated particularly in FIGS. 1, 7 and 8 comprises a lock body 10, a lock handle 11, an actuator 12, and a trigger latch 13. As is well known to one skilled in the art, the lock body is mounted on a window frame member 1 so that the actuator 12 passes through an opening 2 in the window frame member and engages a lock element schematically shown at 3 of a window member 4.

In general terms the lock handle is pivotally mounted on the lock body for movement from a lowered lock position as shown in FIG. 7 in which the actuator 12 engages an element of the window to effect locking of the window against the window frame to a raised release position as shown in FIG. 8 in which the actuator 12 is moved to release the element of the window for opening of the window away from the frame and the window lock, For convenience of illustration the position shown in FIG. 8 is moved only partly into the release position and it will be appreciated that the lock handle can pivot further in the counterclockwise direction to a position approximately at 90° to the front face of the lock body.

The lock body 10 comprises a base plate 14 which has an under surface 15 for engaging an outer surface of the window frame. From the under surface 15 projects a rectangular housing portion 16 with parallel side walls 17 and end walls 18. The side walls are of a spacing less than the width of the rectangular base plate 14 so as to define a shoulder of the under surface 15 which engages the surface of the window frame with the housing portion 16 projecting into a recess or opening in the window frame.

Figure 4:
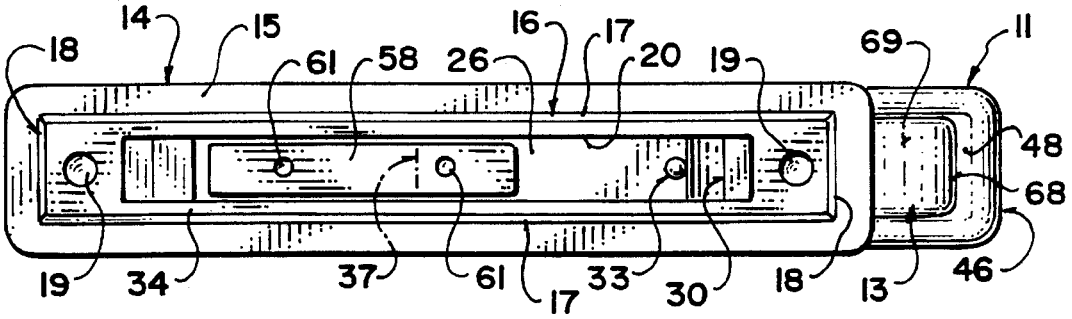
FIG. 4 is a bottom plan view of the lock of FIG. 1.

Each end wall 18 is of increased thickness so as to receive a screw opening 19 by which the housing portion is attached to the window frame. The housing portion as best shown in FIG. 4 has an open bottom 20 exposed at the under surface thereof through which the actuator 12 passes.

On top of the base plate 15 is provided a raised portion 21 defined by two parallel side walls 22 and an end wall 23. The side walls 22 are parallel and spaced by the width of the base plate 14 so that the outside surface of the side walls 22 are flush with the side edges of the base plate 14. The length of the side wall 22 is less than the length of the base plate so that there is a bare portion 14A of the base plate which projects beyond an adjacent end 24 of the raised portion. Both ends of the raised portion are inclined from a top edge 25 of the raised portion downwardly and outwardly to the plane of the top surface of the base plate 14.

The raised portion thus defines at the top edge 25 a plane parallel to the base plate which includes the top edges of the side walls 22 and the top edge of the end wall 23. Between the side walls and the end walls is defined a hollow interior which communicates with the hollow interior of the housing portion 16. The top surface of the raised portion is rectangular and of the same width as the base plate 14 but of reduced length relative to the base plate 14.

The lock body further includes a transverse web element 26 which extends across between the side walls 22 at the level of the base plate 14. The web element 26 includes a first portion 27 parallel to the base plate and extending only part way along the hollow interior from a first end 28 to a second end 29, the latter being spaced from one end wall 18 of the housing portion. At the end 29 is provided a hook element 30 which extends upwardly in an arch shape to a downwardly facing abutment surface 31 positioned beyond the end 29 of the first portion 27. The abutment surface 31 is also spaced upwardly from a top surface 32 of the end wall 18 so as to leave a space therebetween for receiving a hook portion of the trigger latch 13 as described hereinafter.

The web element 26 further includes a pin 33 projecting downwardly into the hollow interior of the housing portion to a position adjacent to but spaced from a bottom surface 34 of the housing portion which lies parallel to the base plate 14 and to the top surface 25 of the raised portion. The pin 33 carries a rubber or resilient sealing member 35. The sealing member 35 has a width equal to the width of the interior of the housing portion and extends partly along the interior of the housing portion from an end 36 at one end wall 18 of the housing portion to a second end 37 spaced beyond the end 28 of the web element 26. Between the end 28 of the web element and the end 37 of the resilient sealing member, the resilient sealing member decreases in thickness defining a curved upper surface 38. For convenience of illustration the resilient sealing member 35 has been omitted from FIG. 4 but the position of the end 37 is illustrated in dotted line.

Figure 5:
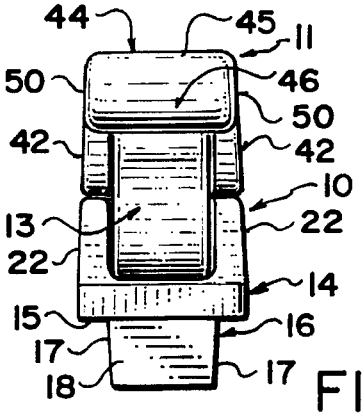
FIG. 5 is an end elevational view of the lock of FIG. 1.
Figure 6:
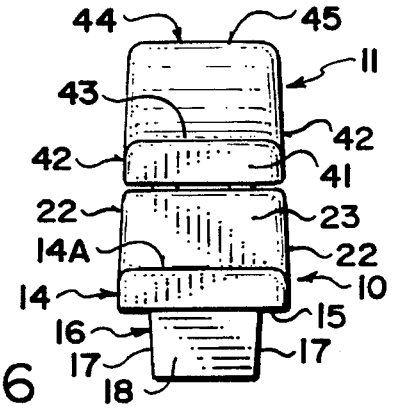
FIG. 6 is a second end elevational view of the lock of FIG. 1.

The lock handle 11 comprises a plate portion 40 which is generally rectangular of a width equal to the width of the upper face 25 of the raised portion and a length equal to the length of the upper face 25 of the raised portion. Thus the handle plate 40 includes a forward end 41 which follows the line of the end wall 23 as best shown in FIG. 7. Thus the end face 41 is chamfered and is inclined upwardly and longitudinally toward the outer or lower end of the handle. The plate 40 includes side walls 42 which are parallel and lie in a common plane with the sides 22 of the raised portion as best shown in FIGS. 5 and 6. The thickness of the plate 40 gradually increases from the end face 41 toward the other end of the raised portion 21. This forms a top surface 43 of the plate 40 which gradually increases in height or spacing away from the top surface 25 of the raised portion 21 thus gradually merging into a manually graspable portion 44 of the lock handle. The manually graspable portion 44 is generally arch shaped so that it includes a top surface 45 which gradually increases in height from the plate 40 outwardly beyond the end of the plate and turns downwardly in a curved nose section 46 at a position beyond an end 47 of the plate 40. This leaves an area underneath the graspable portion 44 in which one or more fingers of the user can be inserted in the area between the end of the raised portion 21 and the underside of the manually graspable portion 44.

The manually graspable portion includes a recess 48 in the underside defining a top surface 49 of the recess and a pair of side legs 50 of the recess. The recess is thus generally U-shaped in transverse cross section with the sides 50 generally parallel and contiguous with the sides 42 of the plate.

The lock handle further includes a pivot portion 51 mounted on an underside of the plate 40 and extending into the hollow interior of the raised portion of the lock body. The pivot portion 51 has a width substantially equal to the width of the interior of the raised portion so that sides of the pivot portion are arranged in a sliding fit with the inside surface of the raised portion. The pivot portion 51 includes at one end a cylindrical opening 52 for receiving a pin 53 passing through openings 54 in the side walls 22 of the raised portion. This allows the pivotal movement of the handle relative to the lock body. The pivot portion 51 includes a bottom surface 55 which is inclined upwardly from a lower most end 56 adjacent the pivot pin 53. The pivot portion terminates at an end wall 57 coterminous with the end wall 47 of the plate portion 40. At its rear end adjacent the end wall 57, the pivot portion is shaped upwardly so as to clear the web 26 and particularly the hook portion 30 thereof when in the lock position shown in FIG. 7.

A rectangular projection 58 is provided on the under surface 55 of the pivot portion and extends downwardly therefrom. The projection 58 is recessed on all sides relative to the under surface 55 to define a shoulder therearound as shown in FIG. 4. Around the projection 58 is provided a rectangular O ring 59. The O ring is rectangular in cross section of the body of the O ring as shown and is also rectangular in plan view so as to surround the rectangular outer surface of the projection 58. For convenience of illustration the O ring is omitted from FIG. 4. The O ring as best shown in FIG. 7 engages an under surface 60 of the front wall 23 of the lock body in sealing relation and also the O ring engages the end 28 of the web 26 in sealing relation. In the locked position, therefore, the O ring acts to seal around the projection 58 to prevent the penetration of air through the hollow interior of the housing portion 17, around the lock handle and out through the front face 25 of the raised portion.

On the underside of the projection 58 is mounted the actuator 12. In the embodiment shown, the actuator 12 is formed as a separate element fastened onto the projection 58 by pins 61. In an alternative arrangement (not shown) the actuator 12 is formed as part of the lock handle as an integral element cast simultaneously from a suitable rigid material. The shape of the actuator below the housing portion is entirely optional and one simple example is shown. It will be appreciated that the shape of the actuator will vary depending upon the device to be actuated. However the upper part of the actuator as indicated at 62 is shaped to receive in the hollow interior of the housing portion and includes an upper face 63 larger than the projection 58 so as to retain the O ring 59 in place. One end of the upper portion 62 as indicated at 64 just clears the end 28 of the web. An under surface portion of the end 64 as indicated at 65 is curved so as to engage the upper curved portion 38 of the sealing member 35 in a sealing action again to assist in preventing the penetration of air around the web 26.

The trigger latch 13 is mounted in the recess 48 on a transverse pivot pin 66 which passes through the side walls 50 of the recess 48. The trigger includes a spring finger 67 which projects outwardly from a position adjacent the pivot pin 66 along the upper wall 49 of the recess 48 into engagement with the upper wall so as to spring bias the trigger latch in a clockwise direction around the pin 66. The trigger latch includes a trigger projection 68 extending from the pivot pin 66 across the bottom of the recess 48 to a position adjacent but spaced inwardly from the nose 46. The upper surface of the trigger portion is spaced from the surface 49 so that the trigger can be pulled upwardly into the recess and can rotate in a counterclockwise direction about the pin 66 against the bias of the spring 68. An under surface 69 of the trigger portion 68 is curved downwardly and forwardly to a position adjacent the plate portion 14 and defines a smooth curve which can be readily grasped by the finger or fingers of a user reaching underneath the manually graspable portion 44 of the lock handle. The trigger latch 13 further includes an abutment wall 70 which engages the end wall 57 of the pivot portion to limit the clockwise movement of the trigger latch about the pin 66. In the normal position of the trigger latch, therefore, it is rotated in the full extent in the clockwise direction until the wall 70 engages the end wall 57 as shown in FIGS. 7 and 8. However it will be appreciated that the trigger latch can be rotated by finger pressure in the counter clockwise direction to move the wall 70 away from the wall 57; Underneath the wall 70 is provided a hook portion 71 which forms an end of the lower surface 69 and engages the end wall 31 of the hook portion 30 of the web 26.

In the position shown in FIG. 7, therefore, the latch trigger 13 is held in position engaging the web so as to prevent movement of the handle into the release position until the hook 71 is moved away from the hook portion 31 of the web. This only occurs if the operator grasps the trigger latch at the same time as grasping the manually graspable portion of the lock handle. It is impossible therefore for an intended intruder to move the lock handle to the release position by applying force on the actuator 12.

However from the point of view of the user, the trigger latch 13 is grasped and moved simply as a part of the action of grasping the manually graspable portion of the lock handle. When the finger of the user is engaged underneath the under surface of the manually graspable portion 44 it automatically engages the under surface of the trigger, pulls the trigger into the recess and releases the latch. When pushing the lock handle into the lock position, the shape of the under surface 69 at the hook 71 causes the trigger to be rotated in the counter clockwise direction as it passes over the upper surface of the hook portion 30 of the web to automatically move into the latch position.

The pivot portion 51 includes a recess 75 over the cylindrical opening 52 and underneath the plate portion 40. This recess is hidden under the plate portion 40 in the lock position as shown in FIG. 7 but allows the plate portion 40 to engage over the front wall 23 in the open release position of the lock handle. The bottom surface of the recess 75 follows a circle around the pivot pin 53 so that this surface just clears the inside surface of the end wall 23 in the action of moving from the locked position shown in FIG. 7 through the partly open position shown in FIG. 8 to a fully open position at right angles to the lock body.

This shape and arrangement of the lock handle allows the lock handle to include the plate portion 40 which covers the rectangular upper surface 25 of the raised portion. This provides an attractive appearance of the handle so that it effectively provides a cover for the rectangular upper surface 25.

Figure 9:
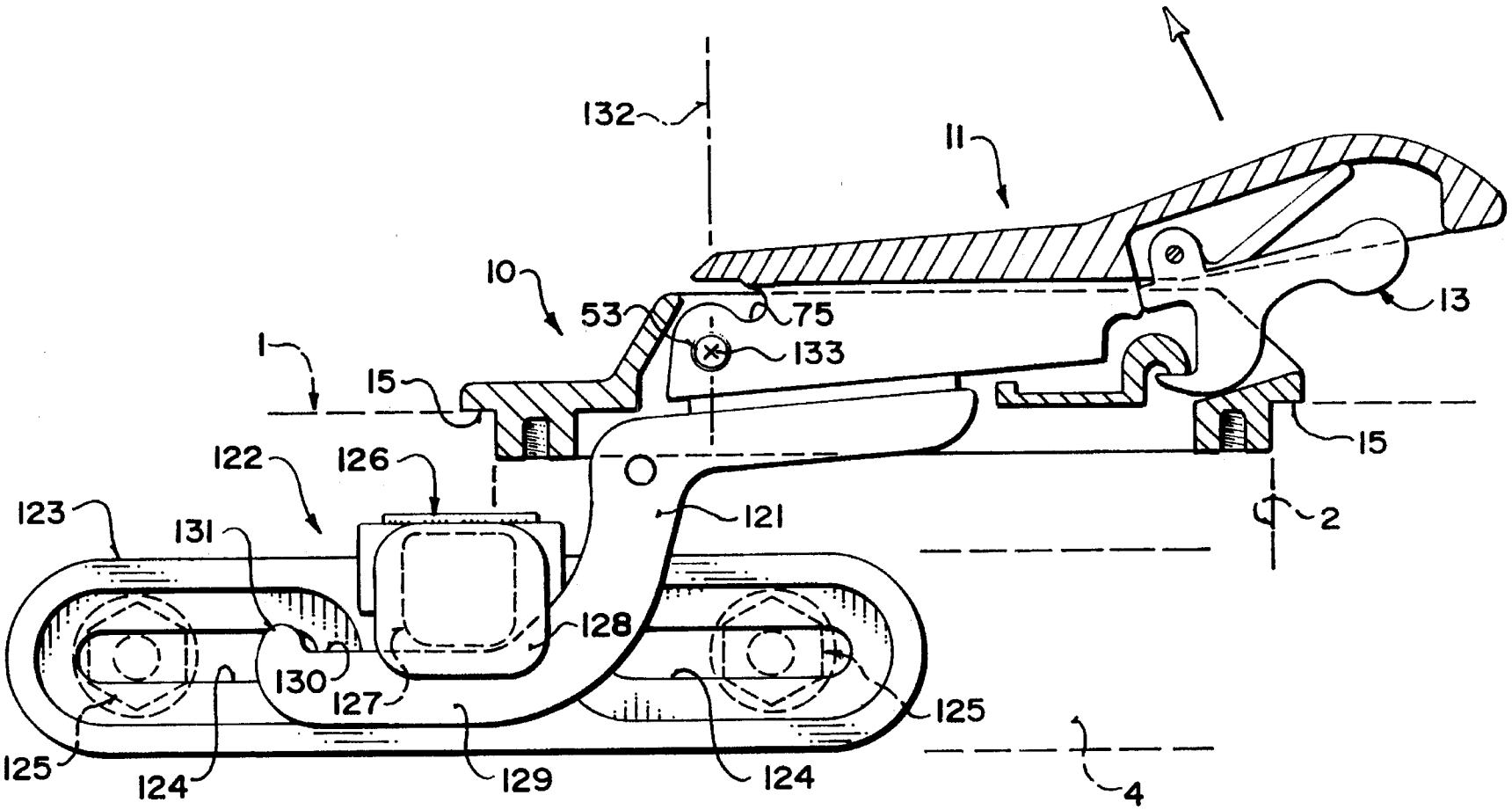
FIG. 9 is a longitudinal cross sectional view of the lock of FIG. 1 in the locked position shown in FIG. 1 and showing the lock for mounting on the window frame (not shown) with a lock actuator arm for directly engaging and holding a keeper on the window (not shown).

Turning now to FIG. 9 there is shown the same lock as previously described and shown in detail in FIG. 8 which includes the mounting member 10, the lock handle 11 pivotal about the pin 53 on the mounting member and including the trigger latch 13. The mounting member 10 includes the flange 15 which locates the mounting member 10 on the window frame 1 so that the actuator 121 extends through an opening 2 in the window frame 1 for engagement with a keeper 122 attached to the window 4.

The keeper 122 comprises an elongated mounting portion 123 with a pair of longitudinal slots 124 through which screws 125 extend for engaging into the window 4. Elongate member 123 sits flush against a surface of the window and provides a projecting portion 126 extending outwardly from the mounting 123. The projecting portion defines a generally cylindrical abutment surface 127 and an end flange 128 so as to trap a portion of the actuator arm 121. The actuator arm 121 includes a hook element 129 which extends away from the underside of the mounting portion 10 and then turns generally parallel to the mounting portion 10 to define an upper surface 130 for engaging the undersurface of the cylindrical abutment surface 127. A nose 131 is provided at the end of the hook portion.

The hook portion of the actuator arm thus projects through the opening 2 to an underside of the window frame 1 and also projects to a side of a plane 132 extending through the axis 133 of the pivot pin 53 which is opposite to the handle portion 11. A pulling force on the window 4 thus will tend to pivot the actuator arm 121 about the axis 133 and to open the handle 11 so that the trigger lock 13 is essential to prevent the handle from simply being popped open thus releasing the hook portion of the actuator 121 from the abutment surface 127. There is no necessity therefore for an over center locking arrangement which causes the handle and the actuator arm to go over center in movement to the locking position. Instead a simple movement to take up the positions on the opposite side of the plane 132 can be accepted in view of the presence of the trigger lock 13.

Figure 10:
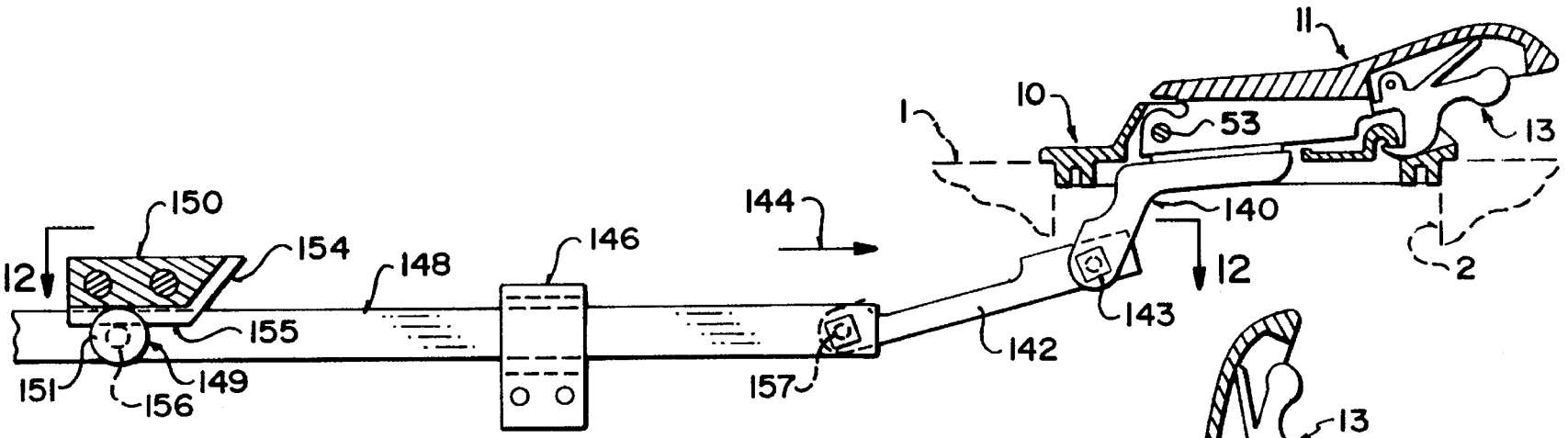
FIG. 10 is a longitudinal cross sectional view of the lock of FIG. 1 in the locked position shown in FIG. 1 and showing the lock for mounting on a window frame (not shown) and including a locking bar for mounting on the window frame for engaging a plurality of keepers of a window (not shown) in a locking action.
Figure 11:
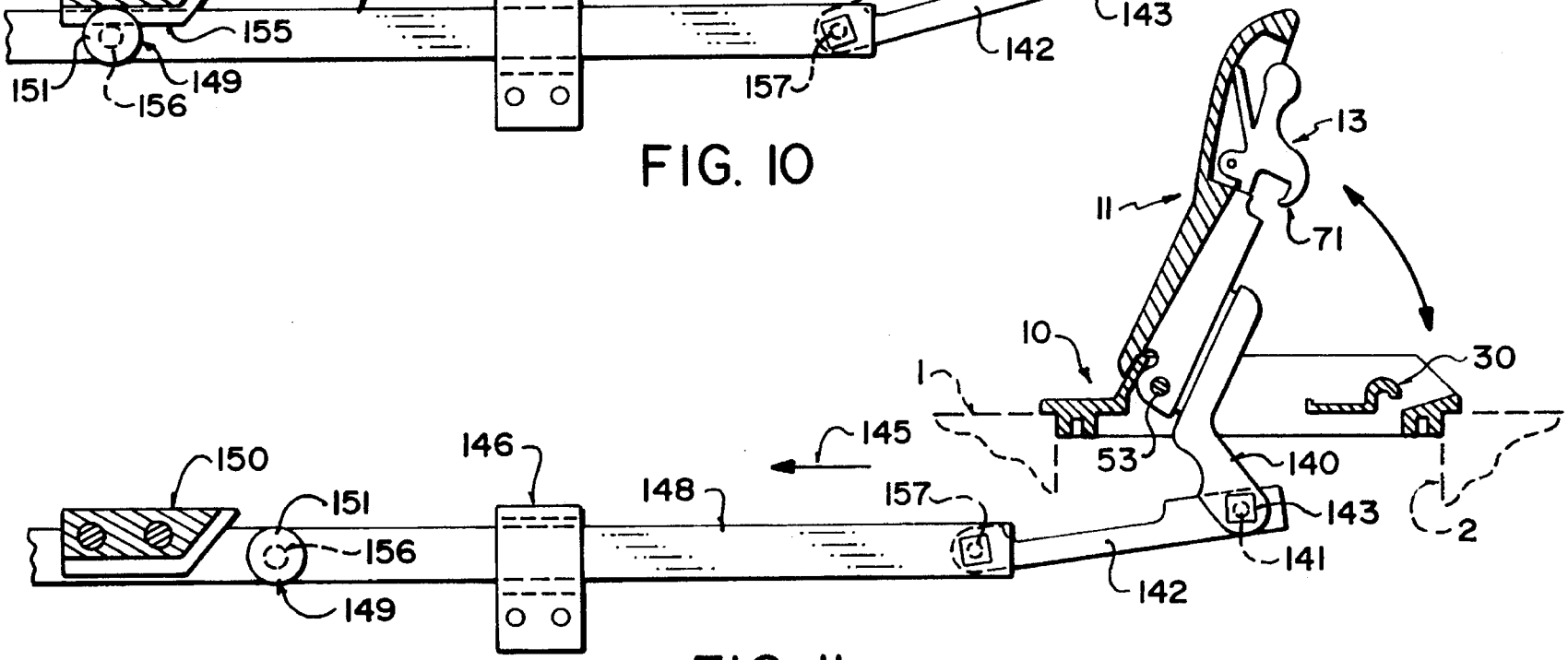
FIG. 11 is a longitudinal cross sectional view similar to that of FIG. 10 showing the lock in an open position.
Figure 12:
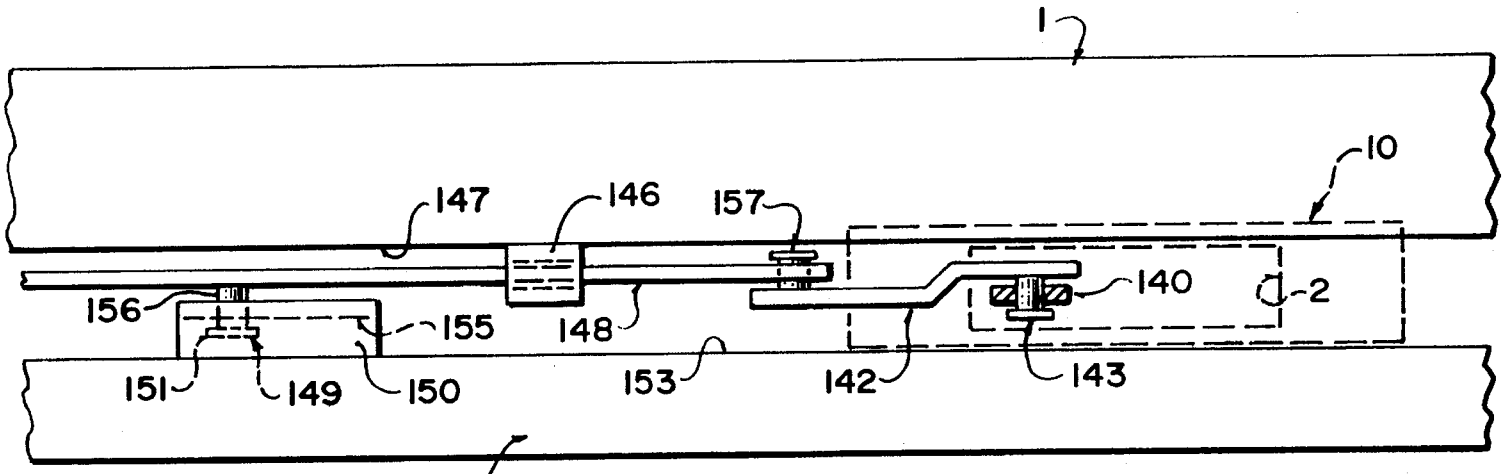
FIG. 12 is a cross sectional view along the lines 12—12 of FIG. 10.

Turning now to the arrangements shown in FIGS. 10, 11 and 12, the same locking handle is shown including the mounting portion 10, the handle portion 11 and an actuator arm 140. In this arrangement the actuator 140 is shaped similar to that shown in FIG. 8 but includes a hole 141 for mounting of a pivotal actuator coupling 142 mounted on pivot bolts 143 to the actuator arm 140. Thus opening and closing of the handle as shown in a comparison of FIGS. 10 and 11 effects movement of the coupling 142 in a direction parallel to the mounting portion 10 in the direction of the arrows 144 and 145. The mounting member 10 is again mounted on the window frame 1 so that the actuator 140 projects through the opening 2 in the window frame. As shown best in FIG. 12, the actuator 140 projects through into an area between the window frame 1 and the window 4 with that area being rebated relative to an outermost surface of the window. Within the recess is provided a slide mounting bracket 146 which is screw fastened to the side face 147 of the recess in the window frame and provides, with similar such slide mounting brackets, a slide guide assembly for an elongate actuating bar 148. The bar extends along the recess against the surface 147 so that it can slide longitudinally in the direction of the arrows 144, 145. The bar carries a plurality of abutment members 149, only one of which is shown in the figures at spaced positions along the length of the bar each for co-operating with a respective one of a plurality of keepers 150 carried on the window 4. Each abutment member 149 includes a cylindrical abutment surface and an end flange 151. Each keeper is also screw fastened to the adjacent surface 153 of the window. Each keeper provides an inclined guide surface 154 and an engagement with surface 155. These surfaces engage the abutment surface 156 of the abutment member 149 so that the inclined surface grasps the abutment member and pulls the keeper and thus the window in toward the window frame in a closing action. Once the abutment surface 156 slides along the inclined portion 154, the abutment surface is retained behind the parallel surface 155 in a locked position. It will be appreciated that along the length of the bar 148 is provided a plurality of similar locking arrangements defined by abutment members and keepers but these are now shown for convenience of illustration.

The double pivot link 142 is pivoted at the pin 143 at one end and a pin 157 at its opposed end to the end of the bar 148. The bar can thus move in a straight line while the pin 143 moves in an arc pivoting about the pin 53 and its pivot axis 133.

In this arrangement the bar is held against longitudinal movement to a release position shown in FIG. 11 from the locked position shown in FIG. 10 by the trigger lock 13. The trigger lock 13 thus prevents forced entry of the locking system simply by a person engaging and moving the bar 148 via a tool inserted into the area between the window and the window frame. It is well known that such locking bars can be accessed and actuated. However the locking bar is advantageous in that it provides simultaneous locking of a plurality of abutment members so as to close a window along the length of the window, particularly when the window has a significant length.

Figure 13:
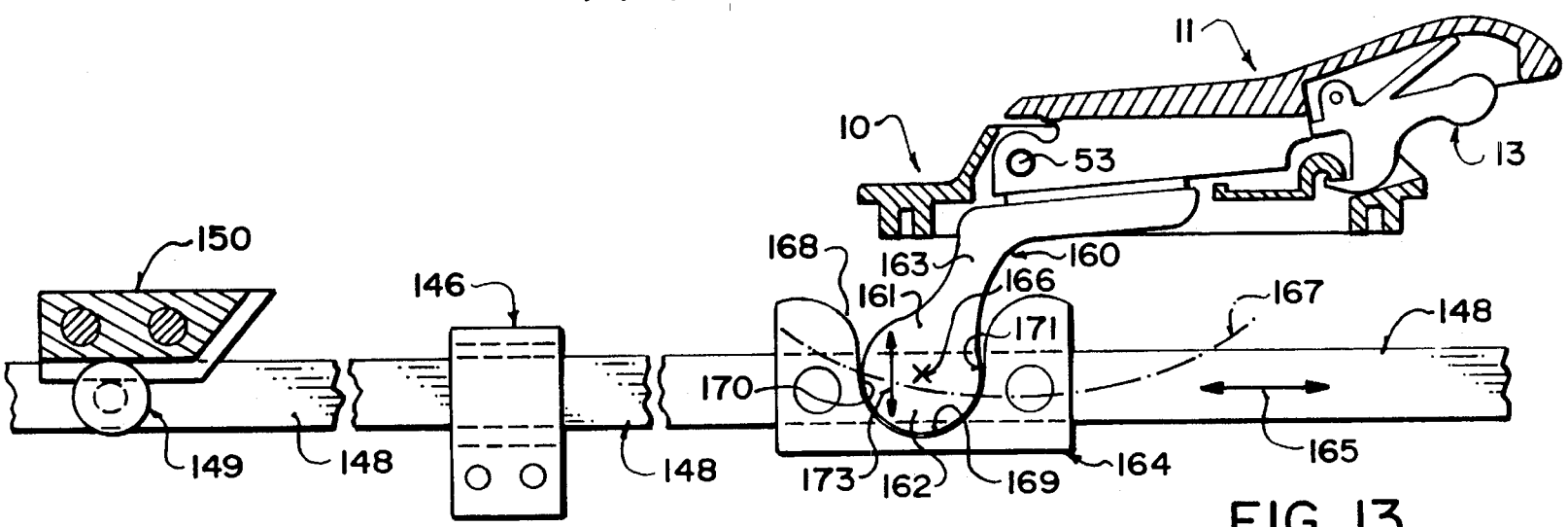
FIG. 13 is a longitudinal cross sectional view similar to that of FIG. 10 showing a modified actuator arm.

Turning now to FIG. 13, there is shown a yet further arrangement which includes the bar 148, the slide brackets 146, the abutment member 149 and the keeper 150. In this case the locking device includes the mounting member 10, the handle 11, the trigger lock 13 and the actuator 160 pivotal about the pin 53 as previously described. In this case actuator 160 is modified so that it includes on its end a disc 161 which is flat and has a circular periphery 162 around the majority of its extent with a relatively narrow coupling portion 163 connecting to the actuator arm itself 160. The disc 161 sits on one side surface of the bar 148 which faces away from the adjacent surface of the window frame against which the bar slides. On the bar is mounted an abutment member 164 which engages the disc 161 so that movement of the disc 161 by the actuator arm 160 causes the longitudinal movement of the bar. The bar, as previously described, moves in a direct straight line along its length as indicated by the arrow 165 while the actuator arm 160 and the disc 161 pivot about the axis of the pin 53. Thus the center of the disc 161 indicated at 166 pivots along an arc 167.

The abutment member 164 includes an abutment surface 168 having a semi-circular portion 169 centered about the center 166 and two straight sides 170 and 171 which are parallel and are tangential to the ends of the semi-circular portion 169.

The differential in movement between the disc 161 and the bar 148 is taken up therefore by sliding movement of the disc relative to the abutment member in a direction of the arrow 173.

In the position of the arc 167 at maximum spacing from the mounting member 10, the disc 161 engages fully into the semi-circular portion 169. On either side of this maximum position, the disc slides in a direction of the arrow 173 away from the portion 169 while the sides of the disc remain in contact with the sides 170 and 171 of the surface of the abutment member. As the disc is circular, this sliding movement is smooth and there is continual contact between both sides of the disc and the respective side of the abutment surface.

This coupling between the actuator arm and the abutment member thus provides a direct coupling without the necessity for any loose pivotal coupling elements of the type shown at 142 and yet provides an effective smooth action of the bar.

Above the straight portions 170 and 171, the abutment surface 168 flares outwardly so as to accommodate the sides of the abutment arm 160 in the extreme positions thereof.

Since various modifications can be made in my invention as herein above described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A window construction comprising:

a window frame member;

a window member movable relative to the window frame member;

and a lock for locking the window member in a closed position against the window frame member;

the lock including a lock element for cooperation with the window member, a lock body mounted on the window frame member at an opening therein and a lock handle mounted for pivotal movement relative to the lock body;

the lock body including a base portion engaged onto a surface of the window frame member, a raised portion projecting outwardly from the surface and a hollow interior of the raised portion;

the lock handle including a mounting portion, means mounting the mounting portion on the raised portion for pivotal movement relative thereto about an axis transverse to the raised portion and the handle and parallel to the surface from a first lock position to a raised release position, and a manually graspable portion extending from said mounting portion to a position in which at least one finger of a hand of a user can engage an under surface of the manually graspable portion for pulling the handle out of said lock position away from said surface of the window frame into said release position;

actuator means mounted on the lock handle and extending through the hollow interior of the raised portion and through said opening in the window frame member for engaging said lock element to lock the window in a closed position;

and latch means for releasably latching the lock handle in the lock position, the latch means comprising an abutment surface on the lock body facing toward the surface of the window frame member and a latch trigger mounted on the lock handle at the under surface of the manually graspable portion so as to be graspable simultaneously with grasping of the manually graspable portion for pivotal movement of the latch trigger relative to the lock handle;

such that the latch trigger is manually movable from a latch position, in which an abutment element on the latch trigger engages the abutment surface, away from the abutment surface to a release position in which the lock handle is released.

2. The window construction according to claim 1 wherein the manually graspable portion comprises an arch shaped section arranged at one end of the mounting portion and wherein the trigger member is arranged underneath the arch shaped portion so as to face the surface of the window frame.

3. The window construction according to claim 1 wherein the manually graspable portion includes a generally channel shaped section having an transverse surface facing outwardly of said surface and a pair of depending side legs extending toward said surface, the legs defining a recess therebetween and wherein the latch member is mounted in the recess.

4. The window construction according to claim 1 wherein the trigger member is spring biased into a latching position and is movable manually against the spring bias into a release position.

5. The window construction according to claim 1 wherein the trigger member is mounted on the lock handle and includes a hook portion thereon defining said abutment element and wherein the lock body includes a pair of upstanding side walls of the raised portion defining the hollow interior between the raised side walls and wherein the lock body includes a transverse web extending across between the side walls and defining said abutment surface for engagement with said hook portion.

6. The window construction according to claim 5 including a separate resilient sealing member mounted on said transverse web for engaging the lock handle in sealing relation therewith.

7. The window construction according to claim 1 wherein the lock handle includes a resilient O-ring surrounding the actuator means, the O-ring being substantially rectangular in plan view and being arranged to engage elements of the lock body within the hollow interior thereof in sealing relation therewith.

8. The window construction according to claim 1 wherein the raised portion defines an upper face thereof lying substantially in a plane raised from the surface of the window frame and wherein the mounting portion of the lock handle comprises a substantially planar plate member, which in the lock position, substantially covers the upper face and is substantially coplanar therewith, the manually graspable portion of the lock handle being provided at one end of the plate member so as to project beyond an adjacent end of the raised portion and wherein said pivot mounting means is arranged at an end of the lock handle opposite to the manually graspable portion.

9. The window construction according to claim 8 wherein the plane of the raised portion is substantially parallel to the surface of the window frame.

10. The window construction according to claim 8 wherein the raised portion comprises a pair of parallel side walls extending substantially at right angles to the surface of the window frame and defining sides of the raised portion such that the upper face of the raised portion is substantially rectangular and wherein the plate member is substantially rectangular and substantially coextensive with the rectangular face defined by said side walls.

11. The window construction according to claim 10 wherein the raised portion includes an end wall substantially at right angles to the side walls at the end thereof adjacent said pivot mounting means and wherein the mounting portion of the lock handle includes a transverse recess parallel to the pivot axis underneath the plate member thereof at the pivot mounting means for engaging over the end wall in the raised release position of the lock handle.

12. The window construction according to claim 8 wherein the manually graspable portion comprises a generally arch shaped member at the end of the plate member and defining an arch shaped upper surface raised upwardly from the plate member.

13. A window construction comprising:

a window frame member;

a window member movable relative to the window frame member;

and a lock for locking the window member in a closed position against the window frame member;

the lock including a lock element for cooperation with the window member, a lock body mounted on the window frame member at an opening therein and a lock handle mounted for pivotal movement relative to the lock body;

the lock body including a base portion engaged onto a surface of the window frame member, a raised portion projecting outwardly from the surface and a hollow interior of the raised portion;

the lock handle including a mounting portion, pivot mounting means mounting the mounting portion at a forward end of the lock handle on a forward end of the raised portion for pivotal movement relative thereto about an axis transverse to the raised portion and the handle and parallel to the surface from a first lock position to a raised release position, and a manually graspable portion at a rearward end of the lock handle extending from said mounting portion to a position in which at least one finger of a hand of a user can engage an under surface of the manually graspable portion for pulling the handle out of said lock position away from said surface of the window frame into said release position;

actuator means mounted on the lock handle and extending through the hollow interior of the raised portion and through said opening in the window frame member for engaging said lock element to lock the window in a closed position;

wherein the raised portion comprises a pair of parallel side walls extending substantially at right angles to the surface of the window frame and defining sides of the raised portion;

wherein the raised portion defines a substantially rectangular upper face thereof, formed by upper edges of the side walls, lying substantially in a plane raised from and substantially parallel to the surface of the window frame;

wherein the mounting portion of the lock handle comprises a substantially planar plate member, which in the lock position, substantially covers the upper face and is substantially coplanar therewith;

wherein the plate member is substantially rectangular and substantially coextensive with the rectangular upper face defined by said side walls;

wherein the raised portion includes an end wall at the forward end thereof substantially at right angles to and interconnecting the side walls;

and wherein the mounting portion of the lock handle includes a transverse recess at the forward end and breaking out onto a front face thereof parallel to the pivot axis underneath the plate member thereof and extending around the pivot mounting means and receiving the end wall therein in the raised release position of the lock handle.

14. The window construction according to claim 13 wherein the manually graspable portion comprises a generally arch shaped member at the rearward end of the plate member and defining an arch shaped upper surface raised upwardly from the plate member.

15. A window construction comprising:

a window frame member;

a window member movable relative to the window frame member;

and a lock for locking the window member in a closed position against the window frame member;

the lock including a lock keeper element mounted on the window member, a lock body mounted on the window frame member at an opening in a surface of the window frame member and a lock handle mounted for pivotal movement relative to the lock body;

the lock body including a base portion engaged onto the surface of the window frame member, a raised portion projecting outwardly from the surface and a hollow interior of the raised portion;

the surface of the window frame member being arranged relative to the window member such that the window member moves in an opening and closing direction substantially at right angles to the surface;

the lock handle including;

a mounting portion;

means mounting the mounting portion on the raised portion for pivotal movement relative thereto about a pivot axis, which axis is transverse to the raised portion and is parallel to the surface, such that the lock handle is movable from a first lock position to a raised release position;

and a manually graspable portion extending from said mounting portion, said manually graspable portion being arranged such that, in the first lock position of the lock handle the manually graspable portion lies substantially parallel to said surface and extends to a position in which at least one finger of a hand of a user can engage an under surface of the manually graspable portion for pulling the lock handle out of said first lock position away from said surface into said raised release position;

an actuator arm mounted on the mounting portion of the lock handle and arranged such that, with the lock handle in the first lock position, the actuator arm extends through the hollow interior of the raised portion and through said opening in the window frame member to a position which is on a side of said surface opposite to said manually graspable portion for engaging said lock keeper element to lock the window member in a closed position;

said actuator arm including a hook portion for engaging under a surface of the lock keeper element, said hook portion being arranged such that a point of contact of the hook portion with the surface of the lock keeper, when the window member is in the closed position, is located on a side of a plane containing the pivot axis and at right angles to said surface of the window frame which is opposite to the manually graspable portion and such that a pulling force on the lock keeper element in said opening end closing direction at right angles to the surface of the window frame to open the window member relative to the window frame member generates a tendency of the lock handle to pivot the actuator arm and the manually graspable portion to the raised release position thereof;

and manually operable latch means having a first portion on the lock body and a second portion on the lock handle which first and second portions can be interengaged for latching the lock handle in the first lock position against said tendency, the latch means being manually operable so as to release engagement between the first and second portions for releasing the lock handle for movement from the lock position.

16. The window construction according to claim 15 wherein the first and second portions the latch means comprise respectively an abutment surface on the lock body facing toward the surface of the window frame member and a latch trigger mounted on the lock handle at the under surface of the manually graspable portion so as to be graspable simultaneously with grasping of the manually graspable portion for pivotal movement of the latch trigger relative to the lock handle;

such that the latch trigger is manually movable from a latch position, in which an abutment element on the latch trigger engages the abutment surface, away from the abutment surface to a release position in which the lock handle is released.

17. A window construction comprising:

a window frame member;

a window member movable relative to the window frame member;

and a lock for locking the window member in a closed position against the window frame member;

the lock including a lock element for cooperation with the window member, a lock body mounted on the window frame member at an opening therein and a lock handle mounted for pivotal movement relative to the lock body;

the lock element comprising an elongate bar mounted on the window frame member for sliding movement therealong in a direction longitudinally of the length of the bar, a plurality of abutment members mounted on the bar at spaced positions therealong for movement therewith and a plurality of keeper elements mounted on the window member each for cooperation with a respective one of the abutment members such that movement of the bar along its length causes the abutment members to engage the keeper elements to pull the window member into a closed position;

the lock body including a base portion engaged onto a surface of the window frame member, a raised portion projecting outwardly from the surface and a hollow interior of the raised portion;

the lock handle including a mounting portion, means mounting the mounting portion on the raised portion for pivotal movement relative thereto about an axis transverse to the raised portion and the handle and parallel to the surface from a first lock position to a raised release position, and a manually graspable portion extending from said mounting portion to a position in which at least one finger of a hand of a user can engage an under surface of the manually graspable portion for pulling the handle out of said lock position away from said surface of the window frame into said release position;

actuator means mounted on the lock handle and extending through the hollow interior of the raised portion and through said opening in the window frame member for engaging an abutment portion on said elongate bar such that pivotal movement of the handle portion causes movement of the actuator means to move the bar to lock the window member in the closed position;

the actuator means comprising a flat disk member lying in a plane parallel to the bar having a substantially circular operating peripheral edge and the abutment portion comprising a receptacle mounted on the bar and defining a recess receiving the disk such that pivotal movement of the disk with said handle portion about said axis causes said longitudinal movement of the bar;

the recess having a semi-circular end portion for receiving said circular peripheral edge therein and two parallel side edges each extending tangentially away from a respective end of the semi-circular end portion.

18. The window construction according to claim 17 wherein there is provided latch means for latching the lock handle in the lock position, the latch means being manually operable for releasing the lock handle from the lock position.

19. The window construction according to claim 18 wherein the latch means comprises an abutment surface on the lock body facing toward the surface of the window frame member and a latch trigger mounted on the lock handle at the under surface of the manually graspable portion so as to be graspable simultaneously with grasping of the manually graspable portion for pivotal movement of the latch trigger relative to the lock handle;

such that the latch trigger is manually movable from a latch position, in which an abutment element on the latch trigger engages the abutment surface, away from the abutment surface to a release position in which the lock handle is released.

* * * * *